United States Patent [19]

Miller

[11] Patent Number: 4,919,115

[45] Date of Patent: Apr. 24, 1990

[54] ARROW REST SPACER

[76] Inventor: Allen W. Miller, 32 Champagne, Lake St. Louis, Mo. 63367

[21] Appl. No.: 405,866

[22] Filed: Sep. 11, 1989

[51] Int. Cl.[5] ..... F41B 5/00

[52] U.S. Cl. ..... 124/24 R; 124/41 A; 403/356

[58] Field of Search ..... 403/356, 362, 370, 16; 124/86, 88, 23 R, 24 R, 41 R, 41 A, DIG. 1; 411/54, 55, 79, 80, 271, 265, 216, 217

[56] References Cited

U.S. PATENT DOCUMENTS

| | | | |
|---|---|---|---|
| 551,737 | 12/1895 | Smith | 411/217 |
| 3,244,161 | 4/1966 | Jenson | 124/41 A X |
| 3,292,607 | 12/1966 | Hoyt, Jr. | 124/24 R X |
| 3,682,505 | 8/1972 | Firth | 403/370 |
| 4,215,666 | 8/1980 | Carroll et al. | 124/41 A |
| 4,592,332 | 6/1986 | Topping | 124/41 A |
| 4,715,355 | 12/1987 | Lattig | 124/41 A |
| 4,809,670 | 3/1989 | Simo | 124/41 A |
| 4,838,237 | 6/1989 | Cliburn | 124/41 A |

FOREIGN PATENT DOCUMENTS

| | | | |
|---|---|---|---|
| 415561 | 4/1910 | France | 411/271 |

*Primary Examiner*—Randolph A. Feese
*Assistant Examiner*—Jeffrey L. Thompson
*Attorney, Agent, or Firm*—Polster, Polster and Lucchesi

[57] ABSTRACT

In combination with a bow having a riser with a generally flat sided cut-away part having an internally threaded passage extending through it, an arrow rest spacer has a shaft with a channel extending axially from the outer end of the shaft, the channel being open at the outer end of the shaft and along at least one axial side of the shaft. A wall of the channel is thicker at an inner part of the channel than it is at the outer end of the channel, to form a shallower channel area in the inner part. The shaft is proportioned to fit closely but slideably in the threaded passage. The shaft is made of a material that is rigid enough to support the arrow rest in use, but elastic enough to permit a threaded plug to form threads in it as it is screwed in, and to expand as the plug moves into the shallower part of the channel. Preferrably, the bow passage is internally threaded, and an externally threaded plug, the threads of which are of the same pitch as the internal threads of the threaded passage, is of a diameter to be received into the channel at its outer end and at the same time to engage the threads of the passage.

16 Claims, 2 Drawing Sheets

ARROW REST SPACER

BACKGROUND OF THE INVENTION

Modern bows have a riser with a handle part and a generally flat-sided cut-away part extending above the handle part. Especially in cam-wheel type bows, the cables must be offset to permit the bow string to move in a plane parallel to a flat side of the cut-away part. The flat, arrow side of the cut-away part has also been offset farther and farther from the longitudinal centerline of the handle. With the introduction of the over draw-type riser box handle, the past center shot design makes it difficult to tune a bow with a standard type arrow rest. Various complicated rests and spacers have been introduced, some of them described in U.S. Pat. No. 4,838,237, for example. Such arrow rests are quite satisfactory, but they are, as has been indicated, complicated and expensive. They are also not necessarily interchangably right handed and left handed.

One of the objects of this invention is to provide an arrow rest spacer that is simple, inexpensive to manufacture, adapted without modification to use with both right and left hand bows, easily adjusted, effective and durable.

Other objects of this invention will be apparent to those skilled in the art in light of the following description and accompanying drawings.

SUMMARY OF THE INVENTION

In accordance with this invention, generally stated, an arrow rest spacer is provided for use with a bow having a riser with a generally flat sided cut-away part extending above a handle part, a broad face of the cut-away part being oriented in a direction generally parallel to the shaft of an arrow being shot, the cut-away part having an internally threaded passage extending through it, generally perpendicular to the broad face. The passage is used to mount spacers as described in Miller U.S. Pat. No. 4,215,666 or arrow rests or various other attachments. The arrow rest spacer of this invention has a face plate, one side of which is planar to receive an arrow rest that can be of the type described generally in Hoyt U.S. Pat. No. 3,292,607, and more up to date versions of which are available from Saber Products Co., for example. A shaft, preferably integral with the face plate, is cylindrical, elongated and straight. It is secured at an inner end to the side of the face plate opposite the arrow rest side, and projects substantially perpendicular to that planar surface in the opposite direction. The shaft has a channel extending axially from the outer end of the shaft toward its inner end. The channel is axial with respect to the shaft, open at the outer end of the shaft, and open axially along the shaft. A wall of the channel is spaced farther from a closed radially outer surface of the shaft at an inner part of the channel than it is at the outer end of the channel, to form a shallower channel area in that inner part. An externally threaded plug, the threads of which are of the same pitch as the internal threads of the threaded passage through the cut-away part of the bow, is small enough in diameter to rest on the bottom wall of the channel at the outer end of the channel but of sufficiently large diameter to engage the threads of the internally threaded passage in the bow. The shaft is of a size to fit closely but slideably in the threaded passage, and is preferably made of a material rigid enough to support the face plate solidly, yet elastic enough to permit the plug to be self threading in the wall of the channel, and to permit the shaft to expand in response to the plug's being screwed into the shallower part of the channel.

Preferably the arrow rest spacer is molded in one piece, of nylon or the like. Also, in the preferred embodiment, annular ribs around the shaft at its inner end are provided to serve as adjustment guides.

DESCRIPTION OF THE PREFERRED EMBODIMENT

Figure 1:
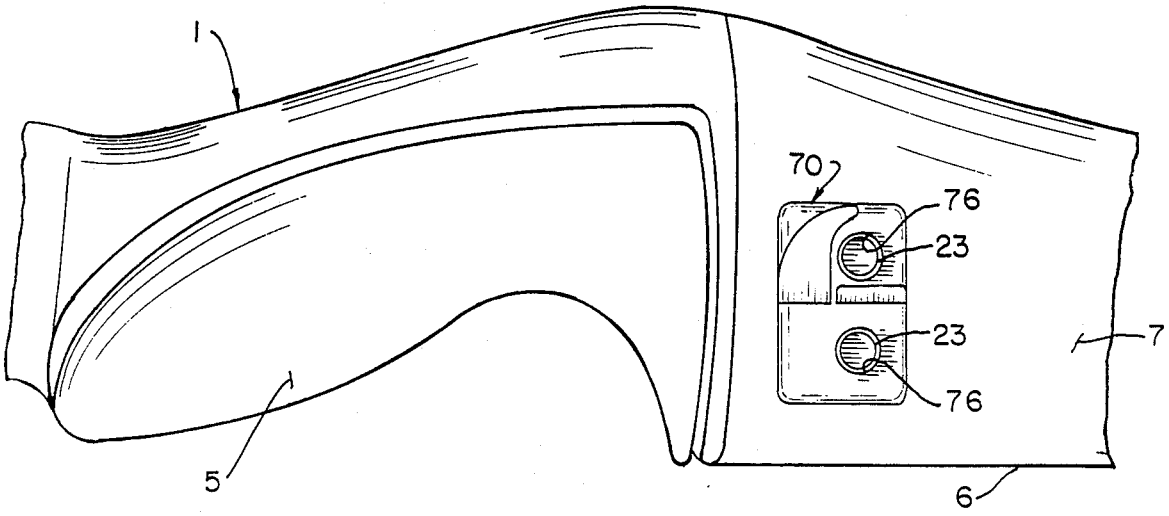
FIG. 1 is a view in side elevation of a bow broken at each end, with one illustrative embodiment of arrow rest spacer of this invention, shown in front elevation, mounted thereon with an arrow rest in place.
Figure 2:
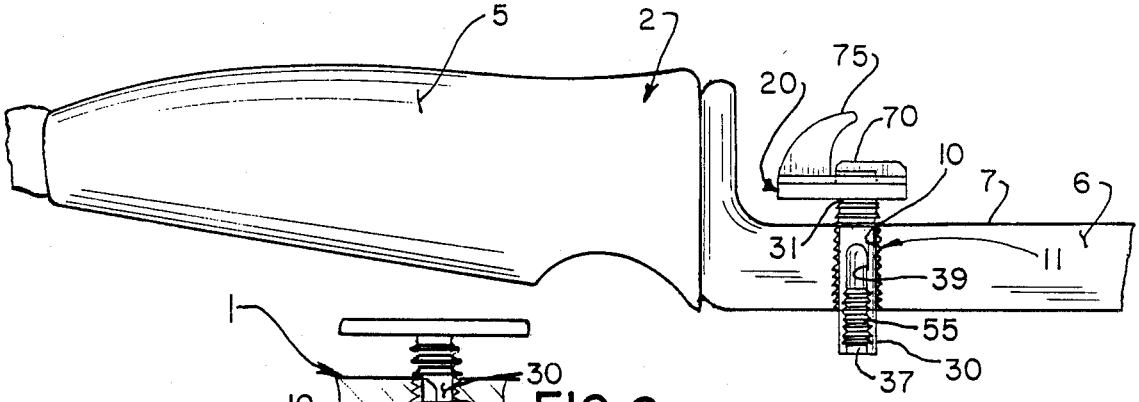
FIG. 2 is a view in edge elevation of the bow with the arrow rest spacer of FIG. 1 shown in side elevation.

Referring now to the drawing, and particularly to FIGS. 1 through 11, for one illustrative embodiment of arrow rest spacer of this invention, reference numeral 1 indicates a bow with a riser 2, including a handle part 5 and a cut-away part 6. The cut-away part 6 has a flat surface 7 defining a plane generally parallel to the shaft of an arrow being shot. The cut-away part 6, has a passage 10, extending entirely through it. The passage 10 has internal threads 11. The bow described is conventional, the internally threaded passage 10 being a standard feature of most bows of this type.

An arrow rest spacer 20 of this invention is mounted adjustably but securely in the passage 10.

In the embodiment of arrow rest spacer and rest shown in FIGS. 1–4, the arrow rest spacer 20 has a face plate 21 with a planar front surface 22 from which annular cups 23 project, and a planar rear surface 25 parallel to the plane of the surface 22. A shaft 30, integral with the rear surface 25, is connected at an inner end 31 to the surface 25, and projects generally perpendicular to the surfaces 22 and 25, to an outer end 32. Spaced axially along the outside of the inner end 31 are annular ribs 33.

Figure 3:
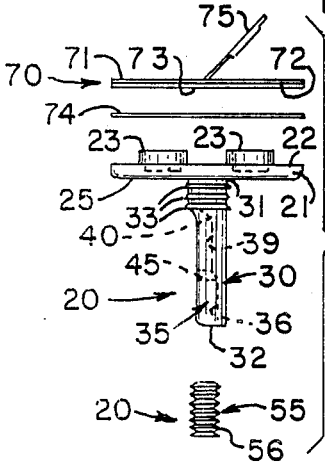
FIG. 3 is an exploded view of the arrow rest spacer shown in FIGS. 1 and 2 with an arrow rest above it.
Figure 4:
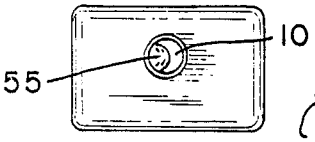
FIG. 4 is a view in front elevation of the arrow rest spacer shown in FIG. 3.
Figure 10:
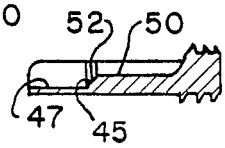
FIG. 10 is a sectional view of the shaft of the arrow rest spacer of any of the illustrative embodiments shown.
Figure 6:
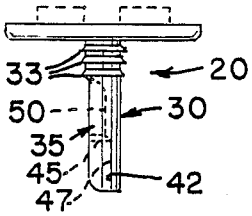
FIG. 6 is a view in side elevation illustrating a way in which the face plate of FIG. 5 can be modified to receive a different arrow rest.
Figure 8:
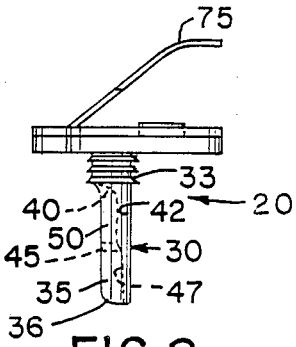
FIG. 8 is a view in side elevation of the arrow rest and arrow rest spacer of FIG. 7.
Figure 11:
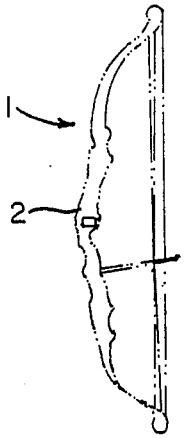
FIG. 11 is a somewhat sketchy view in perspective of a complete bow on which an arrow rest spacer on this invention is mounted.

A channel 35 extends axially along the shaft 30, with an outer end 36 opening in a mouth 37 through the outer end 32 of the shaft 30. An inner end portion 39 of the channel has a dead end 40 short of the inner end 31 of the shaft. Between the inner end 39 and the outer end 36 of the channel, a wall 42 defining the channel is provided with an annular step 45, the step lying between a deep outer part 47 of the channel and a shallow part 50 at the inner end of the channel, said shallow part being effected by a thickening of the channel wall 42 at the shallow end. The step is sloped or chamfered, as shown in FIGS. 3, 6 and 8. The channel 35 is open axially along its entire length.

Figure 9:
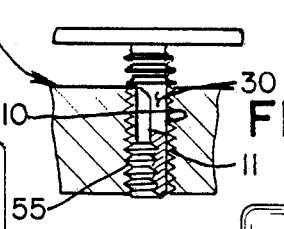
FIG. 9 is a sectional view, partly broken away, of an arrow rest spacer in the process of being secured in a bow.
Figure 5:
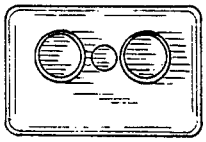
FIG. 5 is a view in front elevation of the face plate of the embodiment shown in FIGS. 1–3.

A set screw or plug 55 with external threads 56, and, in this embodiment, an Allen wrench socket in its outer end, is of a diameter to be admitted through the mouth 37 of the channel but to project beyond the wall of the channel and into engagement with the threads 11 of the passage 10 as shown particularly in FIG. 9. The pitch of the threads 56 of the plug 55 is the same as the pitch of the threads 11. The diameter of the plug 55 is substantially less than the diameter of the passage 10.

In this embodiment, an arrow rest 70 is mounted adhesively to the front planar surface 22 of the face plate 21. In this embodiment, the arrow rest 70 has a sheet 71, on one side of which is an adhesive face 72 with adhesive 73 on it, to which a strippable sheet 74 is mounted before the rest is attached, as is conventional. From the other surface, parallel to the adhesive surface, a rest finger 75 extends at an angle. In this embodiment, the sheet 71 has apertures 76 complementary to the cups 23. The cups 23 are of a height substantially the same as the thickness of the sheet 71, and serve to orient and hold the rest against movement with respect to the face plate.

If a rest sheet has no apertures in it, the cups can be cut off with a sharp knife as indicated in FIG. 6.

Figure 7:
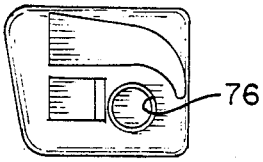
FIG. 7 is a view in front elevation of another embodiment of arrow rest mounted on a face plate.

In FIGS. 7 and 8, a sheet with a single aperture is shown with a slightly different overall configuration, the face plate being complementarily configured. It is obvious that the face plate front surface can be configured in any desired way to accommodate arrow rests of different configurations.

In use, the shaft of the spacer is pushed through the passage 10 from the arrow side of the cut-away part of the riser until the face plate is positioned approximately at the desired distance from the flat surface 7. The plug 55 is placed in the deep part 47 of the channel 35 and screwed into the passage 10, the internal threads 11 meshing with the external threads 56 of the plug. When the inner end of the plug cams over the chamfered step 45 and enters the shallow part 50, the shaft is forced into tight engagement with the threaded wall defining the passage 10, holding the spacer securely in place. If further adjustment is required, the plug is backed out until the shaft can be moved and the spacer moved in or out until it is in the exact position desired. The annular ribs 33 around the outside of the shaft and spaced regularly axially from the inner end 31 of the shaft assist in determining where the platform was initially with respect to the flat surface 7, and where further adjustment should be made.

It is clear that, with the appropriate arrow rest, the spacer itself can be used for either right hand or left hand bows without modification. As can be seen, in the embodiment described, the shaft is connected to the face plate on a center line widthwise, but offset from a center line heightwise. This is to accommodate a standard bow and bow rest as far as the heightwise position of the finger 75 is concerned. The amount of offset, if any, can be varied by the manufacturer of the spacer. If the face plate were made large enough to accommodate the rest in any orientation with respect to the face plate, the vertical distance from the handle portion to the arrow rest could be varied through a substantial distance by joining the shaft to the face plate substantially eccentrically.

Figure 12:
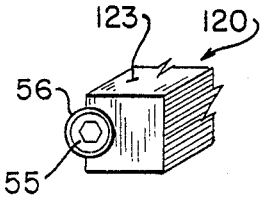
FIG. 12 is a fragmentary view in perspective of a shaft portion of another embodiment of arrow rest spacer of this invention.

Referring now to FIG. 12, reference numeral 120 indicates an arrow rest spacer with a shaft 123 that is rectangular in rear elevation, rather than cylindrical but is otherwise the same as the embodiment shown in FIGS. 1 through 10. To accommodate the shaft 123, the passage 10 is broached, after having been threaded, complementarily to the shaft 123, leaving interrupted threads to be engaged by the threads 56 of the plug 55. The virtue of this embodiment is that the arrow rest spacer can not rotate with respect to the bow. Its disadvantage is that it requires a shaping step to form the passage.

Figure 13:
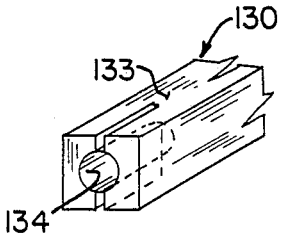
FIG. 13 is a fragmentary view in perspective showing a shaft part of yet another embodiment.

In FIG. 13, an arrow rest spacer 130 is shown, with a substantially square shaft 133, adapted to fit slideably in a square, unthreaded passage through the cut-away portion of the riser of the bow. The shaft 133 is split at its outer end, and formed with a channel in the form of a well 134 opening through the outer end of the shaft and, along the channel, through opposite sides of the shaft. The inner surface of a wall of the shaft defining the channel or well, defines either an inwardly convergent taper, or a step analogous to the annular step 45 of the first embodiment. In either event, the insertion of the plug 55 acts to expand the shaft in the passage, to hold it securely. This embodiment shares the virtue of the embodiment shown in FIG. 12 in that it can not be rotated and therefore its position relative to the bow is fixed in five of the six degrees of freedom.

Figure 14:
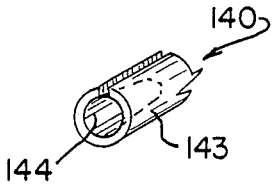
FIG. 14 is a fragmentary view in perspective of a shaft part of still another embodiment of arrow rest spacer of this invention.

In FIG. 14, an embodiment of arrow rest spacer 140 is shown which has the virtue of simplicity and economy, being useable with either a threaded or unthreaded bored passage. However, it is not as effectively fixed against either translation or rotation as the embodiments shown in FIGS. 1 through 13. The arrow rest spacer 140 has a shaft 143 which is split for a distance lengthwise on one side through the length of a channel 144, which is shown as tapered convergently inwardly. The insertion of a plug causes the shaft to expand in the area of the channel in which the plug is mounted.

Figure 15:
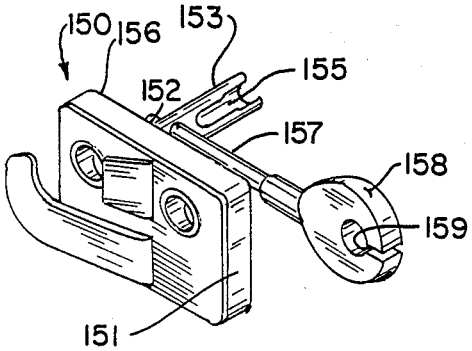
FIG. 15 is a view in perspective of the first embodiment of arrow rest spacer of this invention in combination with an arrow holder.
Figure 16:
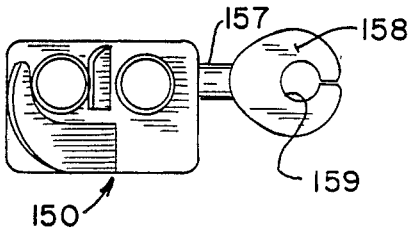
FIG. 16 is a view in front elevation of the combination shown in FIG. 15.

Referring now to FIGS. 15 and 16, an arrow rest spacer 150 is of substantially the same construction as the arrow rest spacer 20 of the first embodiment, except that it is formed with a diametrically extending, tapped hole through a shaft 153, between the inner end of a channel 155 and a planar rear surface 156 of a base plate 151. The axis of the hole is substantially parallel to the top and bottom edges and planar rear surface of the face plate, which is to say, substantially parallel with the shaft of an arrow supported by the arrow rest in use. A threaded stud 152 secured to the end of a flexible rod 157, is mounted in the threaded passage in the shaft 153. An arrow holding head 158 is mounted on the free outer end of the flexible rod 157. The head 158 is made of rubber or similarly resilient material, and is provided with a sort of key hole slot 159 in which the shaft of an arrow can be engaged to hold the arrow in the rest, when the nock of the arrow is in place on the bow string. As is conventional with arrow holders of this general type, when the bow is then drawn, the movement of the arrow in the direction toward the archer causes the head to release the arrow and the flexibility of the head and rod 157 biases the head out of the path of the arrow. The rod 157 can be constituted by a coil spring, as shown in the embodiment shown in FIGS. 17 and 18.

Figure 17:
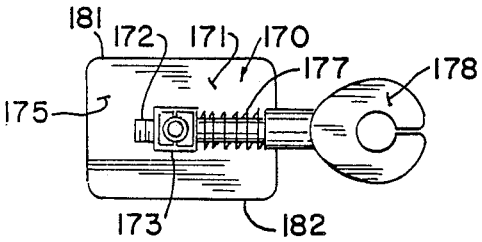
FIG. 17 is a view in rear elevation of the arrow rest spacer of the embodiment shown in FIG. 13 in combination with an arrow holder.
Figure 18:
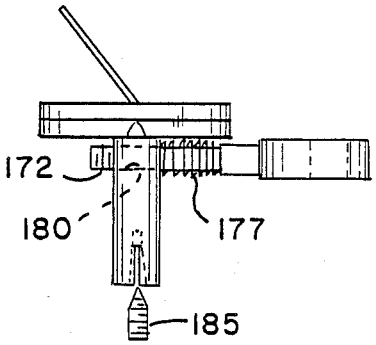
FIG. 18 is a top plan view of the combination shown in FIG. 17.

Referring now to FIGS. 17 and 18, the combination arrow rest spacer and arrow holder shown in FIGS. 15 and 16 and described, is shown in FIGS. 17 and 18, but with the shaft of the embodiment of arrow rest spacer shown in FIG. 13. In this embodiment, an arrow rest spacer 170 has a shaft 173 with a tapped hole 180 extending through it parallel to upper and lower edges 181 and 182 of a face plate 171, and parallel with the plane of a planar rear surface 175. A stud 172 is secured in an end of a rod 177 that in this embodiment is comprised of a tightly wound helical spring, shown loosely spaced for clarity in the drawing. A head 178, identical with the head 158 of the embodiment shown in FIGS. 15 and 16, is mounted on the outer end of the spring-rod 177. A set screw or plug 185 is screwed into a channel 184 in the shaft 173 to hold it against translation from the desired position.

It will be observed that the combination shown in FIGS. 15 and 16 is designed for a right hand bow, whereas the combination shown in FIGS. 17 and 18 is arranged for a left hand bow. This is merely to illustrate the fact that, with the combinations shown in FIGS. 15, 16, 17 and 18, the arrow rest spacer and arrow rest holder are adapted to either right or left hand bow, the only element requiring a different construction being the arrow rest holder which is applied to the planar front surface of the arrow rest spacer. This is, of course, equally true of the arrow rest spacer alone.

Merely by way of example, the arrow rest spacer can be made of nylon. The tapped passage 10 is conventionally five sixteenths of an inch in diameter, with twenty-four pitch threads. The shaft 30 can be nineteen sixty-fourths of an inch in diameter, the channel wall at the shallow inner end, nine sixty-fourths thick, and at the outer, deep part, seven sixty-fourths. The plug 55 can be three sixteenths in diameter, with twenty-four pitch external threads. These dimensions are merely illustrative, but they are satisfactory for a bow with the standard five sixteenths - twenty-four pitch tapped passage.

Numerous variations in the construction of the arrow rest spacer of this invention, within the scope of the appended claims, will occur to those skilled in the art in the light of the foregoing disclosure. The spacer shaft can be made of materials different from nylon as long as it is elastic enough to give in response to the wedging action of the plug but rigid enough to hold the face plate solidly. The spacer can be made in more than one piece, although the one piece construction has numerous advantages. Although the stepped arrangement of the channel has certain advantages in providing a relatively large area of uniform pressure along the length of the shallow part 50, providing, in effect, a large bearing surface, the wall defining the channel can be made to taper uniformly from the mouth to the dead end of the channel. Other non-circular configurations can be given the shaft and bow passage, including a polygonal shape or a rib or spline on the shaft and corresponding channel in the passage, or vice versa. The holder rod can be solid or tubular and made of rubber or flexible metal or plastic instead of a spring. The shaft can be provided with bosses or studs to mount the end of the rod. These are merely illustrative.

Having thus described the invention, what is claimed and desired to be secured by Letters Patent is:

1. In combination with a bow having a riser with a handle part and a generally flat sided cut-away part extending above said handle part, a broad face of said cut-away part being oriented in a direction generally parallel to the shaft of an arrow being shot, said cut-away part having an internally threaded passage extending entirely through it, generally perpendicular to said broad face, an arrow rest spacer comprising a face plate and an elongated, generally straight, shaft having an inner and an outer end, connected at said inner end of said shaft to one side of said face plate and projecting therefrom, said shaft having a channel extending axially from said outer end of said shaft, an outer end of said channel being open at the outer end of said shaft and said channel being open through its length, along one axial side of said shaft, a wall of said shaft an inner surface of which defines said channel being thicker at an inner part of the channel than it is at the outer end of said channel to form a shallower channel area in said inner part, and an externally threaded plug the threads of which are of the same pitch as the internal threads of said threaded passage in the bow, said shaft being of a size to fit closely but slideably in said threaded passage, said plug being of a diameter to be received into said channel at its outer end and to engage the threads of said passage and to tighten the shaft securely against axial movement as said plug is screwed into said shallower channel part.

2. The combination of claim 1 wherein said shallower part of said channel is defined at one end by at least one step in said inner surface of said wall.

3. The combination of claim 2 wherein said shallower part of said channel is defined by one step with a chamfered leading edge.

4. The combination of claim 1 wherein the face plate and shaft are molded in one piece.

5. The combination of claim 4 wherein said face plate and shaft are made of nylon.

6. The combination of claim 1 wherein said face plate has a planar front face, and said shaft projects from an opposite face in a direction perpendicular to said planar front face.

7. The combination of claim 6 wherein said planar front face has projecting from it at least one annular cup.

8. The combination of claim 1 wherein said shaft has annular ribs, spaced axially on and along the outer surface of said inner end of said shaft.

9. The combination of claim 1 wherein an arrow holder is mounted on said arrow rest spacer shaft, with a flexible rod mounted at one end on and projecting substantially perpendicular to the long axis of said shaft, said arrow holder having a resilient head having means for releasably holding the shaft of an arrow.

10. The combination of claim 9 wherein the shaft has an internally threaded passage through it generally parallel with the direction of an arrow on said rest, and the rod of the holder has a threaded stud threadedly mounted in said passage.

11. The combination of claim 1 wherein the passage is interruptedly threaded along a circularly arcuate section and is otherwise non-circular in lateral cross section, and the shaft is complementarily non-circular.

12. An arrow rest spacer for use with a bow having a riser with a handle part and a generally flat sided cut-away part extending above said handle part, a broad face of said cut-away part being oriented in a direction generally parallel to the shaft of an arrow being shot, and said cut-away part having an internally threaded passage extending entirely through it generally perpendicular to said broad face, said arrow rest spacer comprising a face plate and an elongated generally straight shaft connected at an inner end of said shaft to one side of said face plate and projecting therefrom to an outer end of said shaft, said shaft having a channel opening through and extending axially from said outer end of said shaft, said channel being open along one side of said shaft, a bottom wall of said channel being thicker at an inner part of the channel than it is at the outer end of said channel to form a shallower channel area in said inner part, and an externally threaded plug the threads of which are of the same pitch as the internal threads of said threaded passage, said shaft being of a size to fit closely but slideably in said threaded passage, said plug being of a diameter to be received into said channel at its outer end and to engage the threads of said threaded passage and to tighten the shaft securely against axial movement as said plug is screwed into said shallower channel part.

13. In combination with a bow having a riser with a handle part and a generally flat sided cut-away part extending above said handle part, a broad face of said cut-away part being oriented in a direction generally parallel to the shaft of an arrow being shot, said cut-away part having a passage extending entirely through it, generally perpendicular to said broad face, an arrow rest spacer comprising a face plate and an elongated, generally straight shaft having an inner and an outer end, connected at said inner end of said shaft to one side of said face plate and projecting therefrom, said shaft having an elongated channel extending in a direction from said outer end toward said inner end of said shaft, an outer end of said channel being open at the outer end of said shaft and said channel being open through its length shaft along at least one axial side of said shaft, a wall, a surface of which defines at least a part of said channel, being thicker at an inner part of the channel than it is at the outer end of said channel to form a shallower channel area in said inner part, and an externally threaded plug mounted in said channel, said shaft being of a size to fit closely but slideably in said passage, and of a stiff but elastic material, said plug being of a diameter to be received into said channel and to force the shaft into tight engagement with the wall defining the said passage as said plug is screwed into said shallower channel part.

14. The combination of claim 13 wherein the passage is non-circular in lateral cross section and the shaft is complementarily non-circular.

15. The combination of claim 13 wherein an arrow holder is mounted on said arrow rest spacer shaft, with a flexible rod mounted at one end on and projecting substantially perpendicular to the long axis of said shaft, said arrow holder having a resilient head having means for releasably holding the shaft of an arrow.

16. The combination of claim 15 wherein the shaft has an internally threaded passage through it generally parallel with the direction of an arrow on said rest, and the rod of the holder has a threaded stud threadedly mounted in said passage.

* * * * *